US007358920B2

(12) United States Patent
Apostolos et al.

(10) Patent No.: US 7,358,920 B2
(45) Date of Patent: Apr. 15, 2008

(54) CAVITY EMBEDDED ANTENNA

(75) Inventors: John T. Apostolos, Lyndeboro, NH (US); Richard C. Ball, Loudon, NH (US); Stephen A. Hedges, Nashua, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 162 days.

(21) Appl. No.: 10/550,367

(22) PCT Filed: Apr. 2, 2004

(86) PCT No.: PCT/US2004/010008

§ 371 (c)(1),
(2), (4) Date: Sep. 19, 2005

(87) PCT Pub. No.: WO2004/091040

PCT Pub. Date: Oct. 21, 2004

(65) Prior Publication Data

US 2006/0181474 A1 Aug. 17, 2006

(51) Int. Cl.
*H01Q 1/42* (2006.01)

(52) U.S. Cl. ..... 343/789

(58) Field of Classification Search ..... 343/789, 343/700 MS, 702, 821, 866, 829, 830
See application file for complete search history.

(56) References Cited

U.S. PATENT DOCUMENTS 5,774,094 A * 6/1998 Yonezaki ..... 343/770
6,833,815 B2 12/2004 Apostolos
6,967,347 B2 * 11/2005 Estes et al. ..... 257/25
7,170,449 B2 * 1/2007 Eide ..... 343/700 MS
2003/0090406 A1 * 5/2003 Longstaff et al. ..... 342/22
2006/0066495 A1 * 3/2006 Isoifovich et al. ..... 343/770

* cited by examiner

*Primary Examiner*—Huedung Mancuso
(74) *Attorney, Agent, or Firm*—Robert K. Tendler; Daniel J. Long

(57) ABSTRACT

A nested cavity embedded loop mode antenna is provided with an ultra wide band response by nesting individual embedded cavity meander line loaded antenna modules, with the meander lines coupled to a ground plane plate either capacitively or directly so as to provide as much as a 27:1 ratio of high frequency to low frequency cutoff. The nested meander line structure is exceptionally compact and eliminates the problem of a null in the antenna radiation pattern perpendicular to the face of the antenna, thus to provide a loop type antenna pattern at all frequencies across which the antenna is to be operated. The use of the nested meander line configuration provides a flush mount for the antenna having a footprint associated with the larger of the meander line cavities and thus the lowest frequency of operation, the nesting precluding the necessity of providing separate side-by-side meander line loaded antennas which would increase the real estate required. Additionally, a shunted slotline embodiment of the cavity-embedded antenna substitutes shunted slots for meander lines to provide for a low-cost wide bandwidth cavity-embedded antenna.

6 Claims, 8 Drawing Sheets

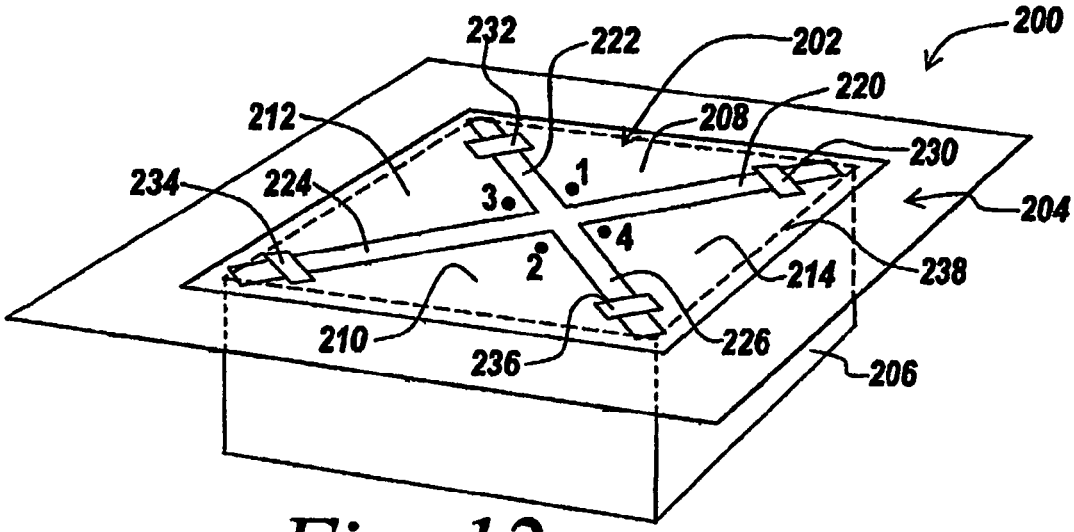
Fig. 12
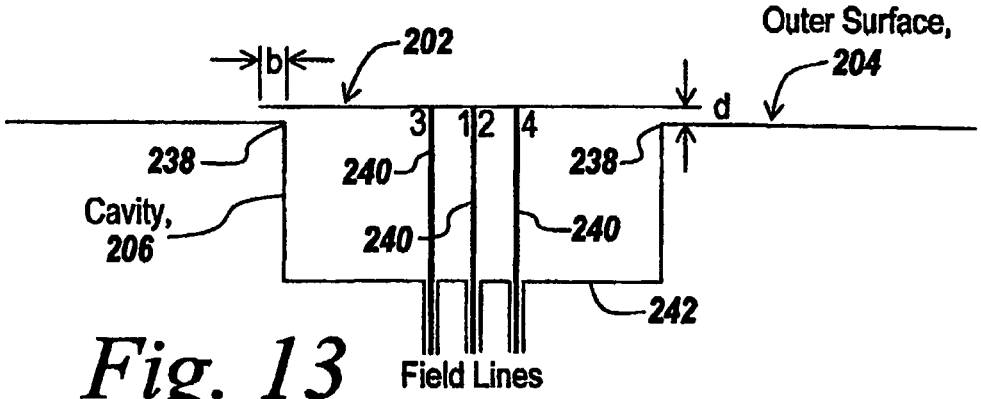
Fig. 13
Fig. 14
| Feed Point | 1 | 2 | 3 | 4 |
|---|---|---|---|---|
| Loop 1, 2 | +1 | -1 | | |
| Loop 3, 4 | | | 1 | -1 |
| Circular Right | +1 | -1 | +j | -j |
| Circular Left | +1 | -1 | -j | +j |

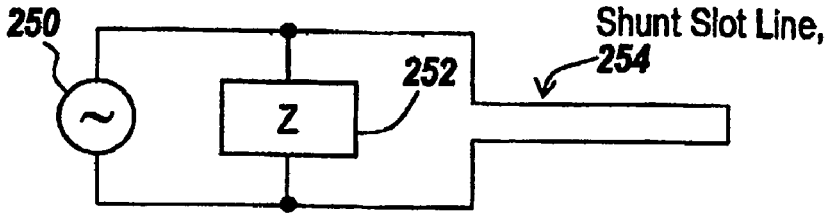
Fig. 15
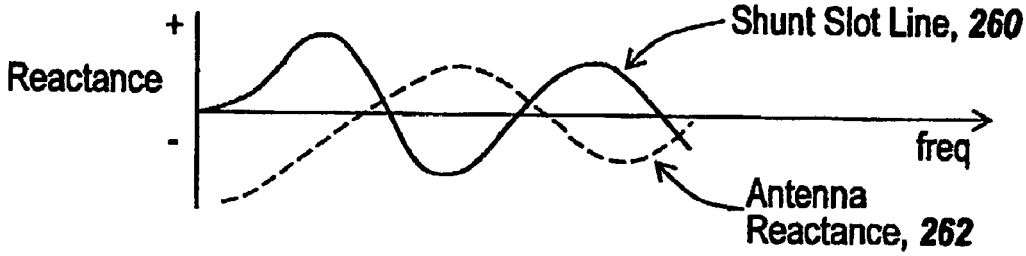
Fig. 16
Gain at Zenith
| Freq MHz | DBI Gain |
|---|---|
| 80 | -3.1 |
| 100 | -1.0 |
| 120 | 0.1 |
| 140 | 1.2 |
| 180 | 2.2 |
| 250 | 2.5 |
| 300 | 3.1 |
| 350 | 2.9 |
| 400 | 3.4 |
| 450 | 5.1 |
| 500 | 4.9 |
Fig. 17

CAVITY EMBEDDED ANTENNA

CROSS REFERENCE TO RELATED APPLICATION

This application is related to U.S. application Ser. No. 10/405,147 filed Apr. 3, 2003, now U.S. Pat. No. 6,828,947.

FIELD OF INVENTION

This invention relates to cavity-embedded antennas and more particularly to a transmission line loaded antenna configuration for providing ultra wide bandwidth.

BACKGROUND OF THE INVENTION

Meander Line Loaded Antennas

As described in U.S. patent application Ser. No. 10/251,131, filed Sep. 20, 2002 by John T. Apostolos assigned to the assignee hereof and incorporated herein by reference, a wide band meander line antenna is configured to be flush mounted to a conductive surface serving as a ground plane by embedding the meander line components within a conductive cavity surrounded at its top edge by the ground plane. This is done with the antenna looking out of the cavity recessed in the surface. By permitting flush mounting of a meander line antenna, not only can the antenna dimensions be minimized due to the use of the meander line loaded antenna configuration, but in aircraft applications no part of the antenna exists above the skin of the aircraft, thereby to minimize turbulence flow.

Moreover, when adapted to wireless handsets or laptop computers, the depth or thickness of the unit need not be increased when providing a wide band antenna, thus to minimize the overall dimensions of the device. Additionally, the flush mounted meander line antenna when utilized in a roof such as in a car does not result in an unsightly protrusion from the top of the car, but rather is hidden in the recessed cavity. This permits that a vehicle can be provided with a wide band antenna that covers not only cellular frequencies but also the PCS band, 802.11, and GPS frequencies.

Such an embedded antenna is based on the meander line loaded antenna described in U.S. Pat. No. 6,323,814 by John T. Apostolos and assigned to the assignee of incorporated herein by reference. It is noted that in this patent a wide bandwidth miniaturized antenna can be provided through the utilization of planner conductors which are feed through a so-called meander line which involves impedance changes to reduce the physical size of the antenna while at the same time permitting wide band operation. Note that the meander lines function as transmission lines for loading the feed points of the antenna.

The plates of the meander line loaded antenna are configured to exist above a ground plane and are spaced therefrom, with a meander line connecting its top plate or element to the ground plane.

Note that the low frequency cut off meander line loaded antennas described in U.S. Pat. No. 6,323,814 and more particularly the meander line loaded antenna described in co-pending patent application Ser. No.:10/123,787, filed Apr. 16, 2002 are assigned to the assignee hereof and are incorporated herein by reference. The low frequency cut off these meander line loaded, antennas is decreased due to a cancellation of the reactance of the antenna by the reactance of the meander line and parasitic capacitance.

While the above summarizes the availability of embedded meander line loaded antennas, it will be appreciated that the bandwidth of such antennas is normally no better than 3:1, a ratio of the highest frequency to the lowest frequency of the antenna.

While such an antenna may be made to operate in the 30 to 90 MHz region of the electromagnetic spectrum, there is a requirement to have the bandwidth of the antenna extend between 30 and 500 MHz, a ratio of 18:1.

Moreover, for automotive applications it is sometimes necessary to go from 800 MHz, the cellular band, all the way up to 6,000 MHz for various applications. It will be appreciated that there is no single-cavity meander line loaded antenna which has such an ultra wide bandwidth.

Pushing the upper frequency limit is a problem while maintaining the low frequency cut off. There is a serious problem if one were to try to extend the upper limit of a wide band embedded meander line loaded antenna in terms of its radiation pattern. While the desired radiation pattern from such an antenna would be a loop type pattern or in general omni-directional, when the depth of the cavity is increased to lower the low frequency cut off of the antenna, there is a significant null in the radiation pattern at the higher frequencies which is normal to or perpendicular to the face of the antenna.

Thus, if when one tries to widen the bandwidth of the cavity embedded meander line loaded antenna, as one goes up in the frequency the cavity depth increases. However, with a depth increase one obtains a null in the straight up direction or the direction normal to the plane of the top plate of the antenna.

What this means is that when trying to devise an ultra wide band antenna, the null in the direction perpendicular to the face of the antenna prevents omni directional radiation patterns and thus prevents the antenna from operating properly when it is directly above either a radiating source or when the antenna is used as a transmitting antenna to project energy downwardly in the direction of the null of the antenna pattern.

Slot Antennas

While meander line structures have been utilized in cavity-embedded embodiments as described above, it will be appreciated that the meander lines themselves, while permitting a broadband miniaturized antenna, are nonetheless costly and relatively difficult to manufacture, especially in quantity. Were one to desire a manufacturable, low-cost cavity-embedded antenna, one would wish to be able to substitute something for the meander line structure which would be less costly and simpler to manufacture.

By way of further background, in the past, slot antennas are available in which the slot acts as a radiator. Popular amongst these types of antennas are the so-called Vivaldi notch antennas in which the curvature of the notch in essence makes the antenna broadbanded. It will be appreciated that the notch does not act as a transmission line for these antennas to load them, but rather is the radiating element itself. The result is that heretofore cavity-embedded antennas have not been provided with notches or slot line structures. What is now discussed is the meander line loaded cavity antenna embodiment which utilizes meander lines and nested cavities to provide an ultrawide bandwidth antenna. Subsequently, what will be described is a slotline-loaded cavity-embedded antenna in which shorted slots or slots provided with absorbers are utilized to approximate the reactance canceling associated with meander lines.

SUMMARY OF THE INVENTION

Meander Line Loaded Cavity Antenna

In order to solve the problem of the null in the orthogonal direction while at the same time providing an exceptionally compact ultra wide band antenna, what one does is to nest and serially connect antenna modules through a common feed, with each module operating in a separate contiguous band to provide continuous coverage. For instance, one antenna module might go from 270 to 500 MHz, where the next module would go from 90 to 270 MHz and a third one from 30 to 90 MHz to provide a 30 to 500 MHz bandwidth. Thus, one way to establish wide bandwidth operation over such a range is to provide three embedded meander line loaded antenna modules working respectively at 30 to 90 MHz, 90 to 270 MHz and 270 to 500 MHz. Note that each of these antenna modules provides a trap so that as one increases frequency. Successive modules come into play by having only the appropriate antenna module radiating energy.

As will be seen, in one embodiment these antenna modules are cavity embedded meander line loaded antennas. In a further embodiment these cavity embedded meander line loaded antennas are nested. This provides a compact miniaturized design with some significant advantages or attributes.

In operation, in the above example when driving this antenna at a frequency between 270 and 500 MHz the first serially-connected module absorbs all the energy, meaning that very little of the energy is transmitted by the 90 to 270 MHz module or the 30 to 90 MHz module. This means that these modules do not contribute to the antenna radiation pattern and thus there is no null.

Moreover, when the frequency goes down from 270 to 90 MHz there is a transition region. For instance, in the transition region half of the power is radiated by the first module, with the second half being radiated by the second module. This occurs at the frequency transition between the adjacent modules. As one moves further lower from 270 MHz all of the energy is radiated by the second module, with the first and third modules radiating little if any energy. In this manner the modules act as antenna traps.

One of the important factors is that as one transits from one module to the next adjacent module one does not want the energy radiated from one module to be out of phase with the energy radiated by the other module. One therefore wants a smooth transition between the modules. What is needed is a geometry associated with modules which accomplishes the transition without frequency domain distortion and this is provided by the subject nesting.

What is therefore provided is a unitary structure that can be made compact and which has a bandwidth defined by the sum of the bandwidths of the nested meander line loaded antenna modules. The nesting removes the problem of driving a given embedded cavity meander line loaded antenna at such a high frequency that a null in the orthogonal direction is created. The nesting of the meander line loaded antenna modules thus provides an ultra bandwidth antenna with a loop like omni directional radiation pattern.

The nesting also minimizes the real estate occupied by such an antenna so that an ultra wide band antenna may be provided embedded into the skin of an aircraft, yet still operate over an exceedingly wide frequency band.

More particularly, in order to provide an ultra wide response to a meander line antenna, a series of separate meander line loaded antennas which are cavity embedded are nested, one in side of the other, with the meander lines for the various adjacent bands being coupled to the top ground plates of the antenna, either by capacitive coupling or by direct coupling.

It has been found that by so doing, the effective radiation pattern for the antenna over the entire ultra wide bandwidth is omni-directional or loop like, with any null in the direction normal to the face of the antenna being eliminated.

The bandwidth of such an antenna can be arbitrarily wide depending on the number of nested meander line loaded antenna components that are serially coupled together. Note that all of the antenna modules have a common feed. The use of a number of meander line loaded antenna components nested one within the other, eliminates the orthogonal null that would be created if one were to try to use only one embedded cavity meander line loaded antenna and drive it to higher frequencies. This means that for an original allocation of real estate, for instance, on an aircraft, an antenna may be provided with an exceedingly wide band response through the subject nesting.

In one embodiment, the innermost of the nested cavity embedded meander line loaded antennas has a portion of its meander line capacitively coupled to an overlying ground plane plate. The next outer cavity embedded meander line loaded antenna has a portion of its meander line also capacitively coupled to the ground plane plate. The last of the nested cavity embedded meander line loaded antennas has its upper most meander line portion directly coupled to the ground plane plate.

In one embodiment, the common feed for such a nested arrangement goes up through the nested cavities, and when balanced is coupled across the innermost portions of opposed ground planes.

While there are critical military requirements for ultra wide band flush mounted antennas for use on aircraft, military vehicles and the like, the ultra wide bandwidth of such antennas is also critical in wireless devices including wireless LANS, laptop antennas and all manner of multi-band operation including ultra wide band transmissions.

In summary, a nested cavity embedded loop mode antenna is provided with an ultra wide band response by nesting individual embedded cavity meander line loaded antenna modules, with the meander lines coupled to a ground plane plate either capacitively or directly so as to provide as much as a 27:1 ratio of high frequency to low frequency cutoff. The nested meander line structure is exceptionally compact and eliminates the problem of a null in the antenna radiation pattern perpendicular to the face of the antenna, thus to provide a loop type antenna pattern at all frequencies across which the antenna is to be operated. The use of the nested meander line configuration provides a flush mount for the antenna having a footprint associated with the larger of the meander line cavities and thus the lowest frequency of operation, the nesting precluding the necessity of providing separate side-by-side meander line loaded antennas which would increase the real estate required.

Slotline Loaded Cavity Antenna

Rather than utilizing the relatively costly meander line structures, in the subject invention it is noted that in a quad bowtie configuration there are spaces between the triangular-shaped bowtie elements which, if shorted at the distal end of the channels between the bowtie elements, constitute slotted transmission lines. These slotted transmission lines, rather than functioning as radiators for the antenna, instead function to load the feed points of the antenna with an impedance that is set by the slotted transmission line. Note in one embodiment the slot is shunted by a short and in another embodiment by an absorber.

Because of the quad bowtie assembly, it has been found that the impedance which is characteristic of the shunted slotline can be configured to cancel out the reactance of the antenna in much the same way as meander lines do.

The result is that, size for size, the shunted slotline-loaded antenna operates almost identically to the meander line loaded antenna configuration.

It is interesting to note that the adjacent triangles of the quad antenna offer a perfect opportunity to provide slots which can be shunted.

In summary, in an effort to reduce the cost of manufacture, a system is substituted for meander lines in quad-type cavity-embedded antennas by understanding that the slots between the triangular-shaped elements of the quad antennas can be turned into transmission lines by putting a short across the gap between the bowtie elements. Tuning is achieved by moving the shunt around so that one basically adjusts the length of the slot itself. The shorted slot itself now becomes a transmission line similar to a meander line which also functions as a transmission line. Both of these structures can load the feed points of a quad-type bowtie-shaped cavity-embedded antenna, with the impedance being adjustable through the setting of the short or shunt to get the antenna to work over a wide band by canceling out the reactance of the antenna.

The short is utilized for maximum gain applications, whereas the absorber is utilized to smooth out the antenna pattern where gain is less critical.

It will be noted that in the absorber embodiment the absorber makes the antenna work like a traveling wave antenna where a wave propagates out and then returns back. The absorber in essence limits the back reflection so that there is little reflected wave to interfere with the outgoing wave. Under normal circumstances a strong reflected wave would produce an interference pattern between the reflected wave and the incident wave as it travels out along the notch or slot. In the shorted slotline case, one would expect nulls in the antenna patterns. If one is interested in canceling the nulls, then the absorber limits the back-reflected wave to regularize the impedance at higher frequencies.

It is noted that in the slotline-loaded case, the transmission lines formed by the slots are shunted so that the impedance at the feed points now becomes a combination of the reactance of the antenna and the impedance of the transmission line. One can adjust the transmission lines by sliding the short or the absorbers to different distances from the feed points to effectively cancel out or minimize the reactance of the antenna.

By so doing, the antenna can be made small and yet still accommodate the lower frequencies. For instance, at 80 MHz the wavelength is about 150 inches. However, it has been found that the antenna dimensions can be reduced to 25 inches by 25 inches, with the slotline-loaded transmission line configuration canceling out antenna reactance caused by making the antenna so small. The result is that adequate gain can be achieved as low as 80 MHz. It will be appreciated that by reducing the overall size of the antenna from 150 inches by 150 inches to 25 inches by 25 inches, the antenna is short and therefore has high reactive components at the low end of its frequency band. The meander lines and now the shorted slotline transmission lines cancel out these high reactive components at the low end of the frequency band. The result is that one can achieve a relatively wideband bowtie slotline-loaded quad antenna which, depending on the feed structure of the antenna, can be right-hand circularly polarized, left-hand circularly polarized or linearly polarized in one of two directions.

As can be seen, the effect of the slotlines is to put a shunt impedance across the feed points of the antenna such that the impedance seen at the input terminals of the antenna is a parallel combination of the slotline impedance and the reactance of the antenna. As mentioned hereinabove, one can adjust the length of the slot so that one can get effective cancellation of the reactance of the antenna or at least minimize it.

Moreover, the depth of the cavity can be kept small, with the depth of the cavity for 80 MHz in one embodiment being only eight inches. Eight inches compared to the wavelength of 150 inches at 80 MHz is a ratio of 8/150 or 0.0533. It has been found that even with a cavity of such small dimensions, one can have adequate performance between 80 and 500 MHz, which is a 6:1 ratio. At the low end of the band it has been found that the antenna has a usable −3.1 DBI gain, whereas at the top part of the band the gain is a full 5 DBI. Note that these gains are measured at the zenith of the antenna. As one goes down to the horizon it has been found that the gain stays fairly constant for vertical polarization, assuming that one is utilizing a ground plane.

It will be appreciated that the subject slotline-loaded quad antenna may be used in the nested case for the lower frequency cavity, the largest cavity. This decreases the cost of the nested antenna by virtue of the fact that the largest and most expensive meander line loaded antenna cavity is now provided with inexpensive shunts or shorts across the associated slotlines.

BRIEF DESCRIPTION OF THE DRAWINGS

These and other features of the subject invention will be better understood in connection with the Detailed Description in conjunction with the Drawings, of which:

FIG. 12 is a diagrammatic illustration of a shunted slotline cavity-embedded antenna, showing shorts across slots formed by the gaps between adjacent bowties arranged in a quad configuration;

FIG. 13 is a diagrammatic side view of the antenna of FIG. 12, showing the feed structure for the antenna of FIG. 12 along with top plate overlap and spacing from the cavity;

FIG. 14 is a chart showing feed configurations for obtaining linear and circular polarizations for the antenna of FIG. 12;

FIG. 15 is a schematic diagram of the impedance at the feeds point of the antenna, showing the antenna reactance Z and a shunted slotline in parallel with the antenna reactance;

FIG. 16 is a graph showing the cancellation of antenna reactance with shunt slotline impedance to achieve a wideband response for the antenna;

FIG. 17 is a chart showing gain at the zenith of the antenna of FIG. 12, illustrating acceptable gain from 80 MHz to 500 MHz;

DETAILED DESCRIPTION

Figure 1:
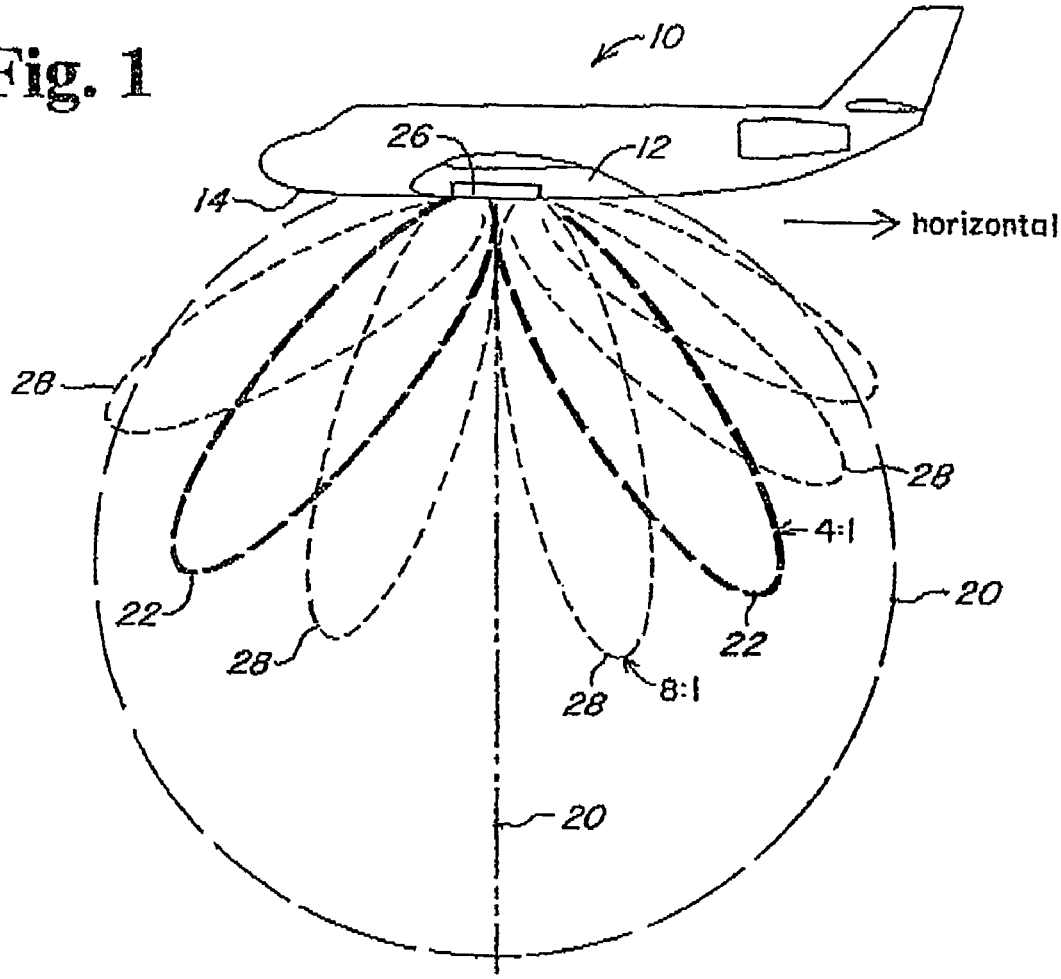
FIG. 1 is a diagrammatic representation of the utilization of an ultra wide band antenna for communications between an over flying aircraft and the ground, or for surveillance, in which the desired antenna radiation pattern is a loop type pattern, whereas the undesired radiation pattern includes a number of lobes resulting in a significant null directly underneath the aircraft.

Referring now to FIG. 1, in one application for an ultra wide band antenna, an aircraft 10 carries an antenna 12 on the under surface 14 thereof, with purpose of the antenna to either transmit energy toward the surface of the earth or to receive radio frequency energy generated at the surface of the earth.

There are a number of things that are highly desirable in such an application. First, the antenna itself should be embedded within the fuselage of the aircraft so as to minimize wind resistance. Secondly, the antenna should be a small as possible so as to take up as little real estate as possible on the aircraft. This is because of the already cluttered environment due to the multitasking of the aircraft. Thirdly, the antenna pattern should have a loop type antenna pattern which in some cases resembles half of a dipole antenna pattern, but importantly has a significant portion of the lobe extent in the horizontal direction as well as the vertical direction.

Most importantly, the antenna used on the aircraft must be an ultra wide band antenna, meaning that in one embodiment the operating frequency of the antenna should be for instance between 30 MHz and 500 MHz. This type of ultra wide band performance permits surveillance over a wide range of frequencies, permits spread spectrum frequency hopping over a wide range of frequencies and in general provides an antenna which can operate in a number of different applications.

As mentioned hereinbefore, a cavity embedded meander line loaded antenna has been provided which can be embedded into the skin of an aircraft. The prior embedded meander line loaded antenna has a moderately wide band response, typically between 30 and 90 MHz. However, for the above noted applications, it is highly desirable to extend the bandwidth of the antenna from the 30 MHz all the way up to 500 MHz.

The typical ratio of a conventional wide band cavity embedded meander line loaded antenna is 3:1, meaning that the top cutoff frequency is 3 times that of the low cutoff frequency. However, with a 30 to 500 MHz desirable bandwidth, a ratio of 18 to 1 is required. In fact it would be extremely desirable to be able to extend the upper frequency limit of such a cavity embedded meander line loaded antenna as much as desired for various applications. Indeed, with the subject nested cavity embedded meander line loaded antenna and techniques to be described, a 27 to 1 ratio has been achieved.

Referring back to FIG. 1, the desired loop antenna pattern is illustrated at 20. However, as one seeks to increase the high frequency cutoff of a cavity embedded meander line loaded antenna, at the higher frequencies for instance at 4:1, two lobes, here illustrated at 22, exist for the higher frequencies. As will be seen the result is a significant null at a direction 24 perpendicular to the face 26 of the cavity embedded meander line loaded antenna.

As one seeks to extend the upper frequency cutoff for such an antenna to for instance 8:1, then four lobes here illustrated at 28 exist at the higher frequencies, again resulting in a significant downwardly pointing null 24.

Figure 2:
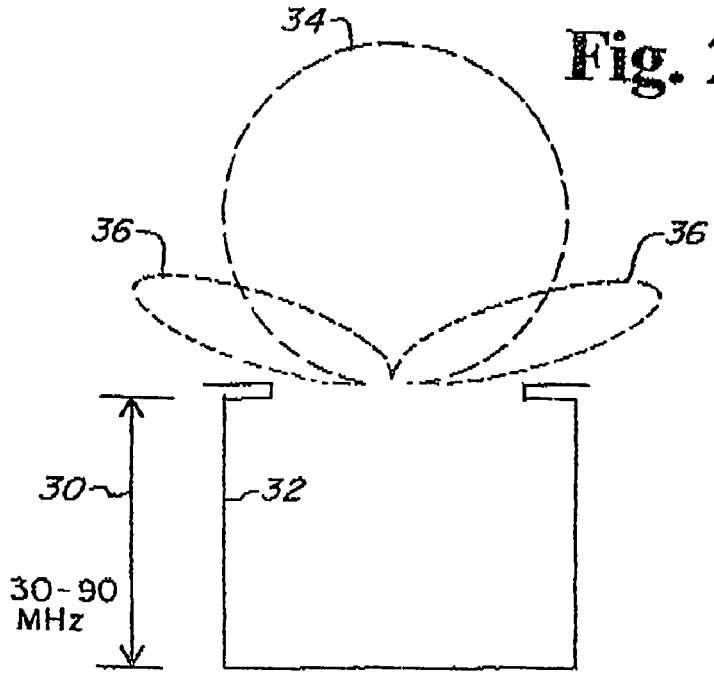
FIG. 2 is a diagrammatic representation of the result of trying to extend the upper frequency limit of a cavity embedded meander line loaded antenna when using the deep cavity associated with a low frequency cut off.

Referring to FIG. 2, the null production is a function of the depth 30 of the cavity 32 of a meander line loaded antenna. Here it can be seen that the depth of cavity 32 for a 30 to 90 MHz antenna is on the order of 32 inches, with the horizontal dimensions of the antenna being 64" by 64". The antenna pattern at 30 MHz is illustrated by loop 34, whereas the antenna pattern at 500 MHz is shown by the lobes 36. The reason for the production of the lobes is the depth of the cavity which has multiple resonances or exhibits multiple resonant wavelengths as the frequency decreases and the cavity depth increases. Note that the depth of the cavity is such that straight above the cavity reflections from the bottom of the cavity are out of phase with the direct wave from the antenna. E. g., at 500 MHz the cavity depth is about one wavelength, resulting in a null straight up. There is also a null at a lower elevation angle, e.g., 30 degrees. In order to provide for the ultra bandwidth and ratios exceeding 15:1, the subject invention involves nesting of the previously-described cavity embedded meander line antennas, with each antenna treated as an antenna module having the appropriate cavity depth so as not to have the above-mentioned out-of-phase condition. Thus, each nested module has its own loop type antenna characteristic, with the depth of the cavity for the lowest frequency module not present for modules operating at a higher frequency band. As will be appreciated, modules operating at a higher frequency band have shallower cavities and for its band do not result in out-of-phase cancellations which result in nulls.

Figure 3:
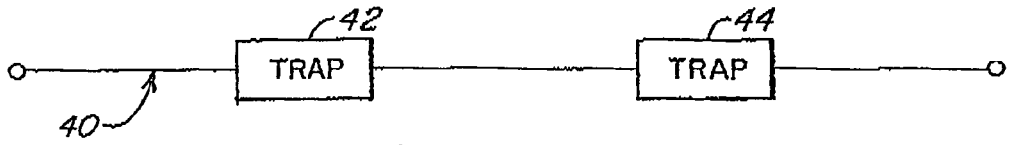
FIG. 3 is a schematic diagram of a trapped antenna configuration in which each of the segments of the antenna is provided with a trap between it and the next adjacent segment, with the antenna providing coverage over different bands.

Referring to FIG. 3, in order to provide for the wideband frequency coverage, the subject antenna may be likened to a beam antenna 40 with traps 42 and 44 that divide up the resonant frequency response of the antenna element into a number of sub-bands.

Figure 4:
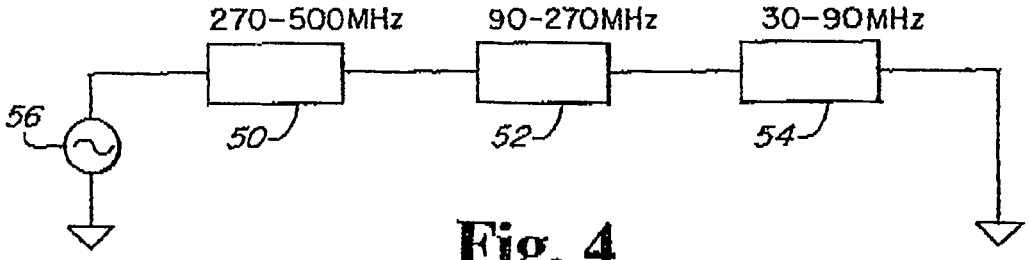
FIG. 4 is a diagrammatic illustration of the operation of the cavity embedded meander line loaded antennas illustrating that the common feed for the antennas is such that the meander line loaded antenna module for the 270 to 500 MHz band precedes the 90 to 270 MHz band module, which in turn precedes the 30 to 90 MHz band module.

Referring to FIG. 4, if the nested cavity embedded meander line loaded antenna modules have 270 to 500 MHz band as illustrated by module 50, a 90 to 270 MHz band as illustrated by module 52 and a 30 to 90 MHz band by module illustrated at 54, when these modules are coupled in series with a signal source 56 to ground, then assuming the signal source outputs a frequency between a 270 and 500 MHz, module 50 will radiate all this energy, leaving virtually no energy to be radiated by modules 52 and 54. Likewise, if the signal source 56 outputs a frequency between 90 and 270 MHz, then modules 50 and 54 will radiate virtually nothing, whereas module 52 will radiate the majority of the energy. Finally, when signal source 56 outputs signals in the 30 to 90 MHz band, then module 54 performs the majority of the radiating, whereas modules 50 and 52 will radiate virtually no energy.

Figure 5:
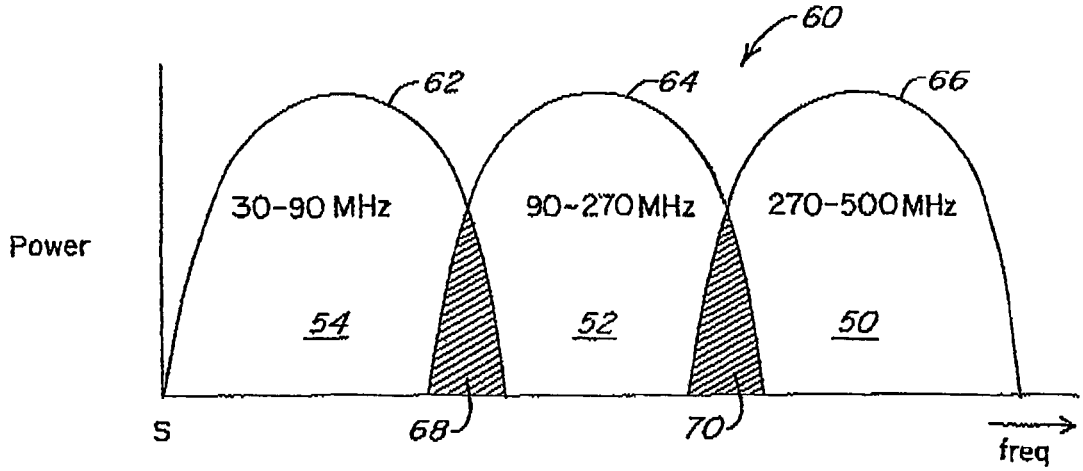
FIG. 5 is a waveform diagram illustrating the overlap in the response of the antenna modules of FIG. 4, illustrating an area at which frequency overlap can cause frequency domain distortion.

Referring to FIG. 5, a power versus frequency waveform 60 is illustrated. Here the response of the 30 to 90 MHz module 54 is illustrated by waveform 62, the response for the 90 to 200 MHz module 52 is illustrated at 64, and the response for the 270 to 500 MHz module 50 is illustrated at 66.

However, between the adjacent bands the will be an area of overlap, here illustrated at 68 and 70. It is important that these overlapped regions not produce a multi-lobe pattern.

It is the finding of the subject invention that the subject nested cavity embedded meander line loaded antenna modules do not have significant interference in the overlapped regions, such that the characteristic antenna lobe from the lowest frequency to the highest frequency is a single lobe or loop.

Figure 6:
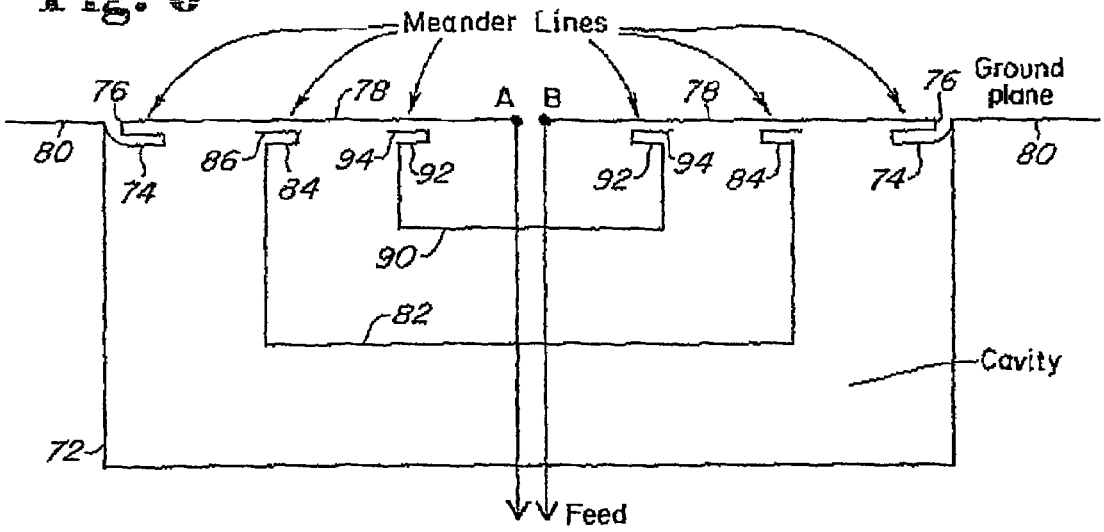
FIG. 6 is a schematic and side view of the subject cavity embedded nested meander line loaded antenna, illustrating the nesting of a number of cavities starting from the highest frequency band antenna down to the lowest frequency band antenna, showing both capacitive and direct feed coupling of the meander lines to the ground plane serving as the face of the antenna.

How this is accomplished is a result of the use of the nested configuration shown in FIG. 6, in which the array is nested, but has a common feed.

For the 30 to 90 MHz band, a cavity 72 is provided with a meander line 74 that is directly connected at 76 to a ground plane plate 78 shown as being bifurcated into a left hand portion and a right hand portion. The top periphery of cavity 72 is directly connected to ground plane 80 which surrounds the aperture of the nested antennas. For the 90 to 270 MHz band, a cavity 82 is nested within cavity 72, with cavity 82 having a meander line 84 capacitively coupled to ground plane plate 78. Here it can be seen that there is a space between the upper most portion 86 of the meander line and the bottom surface of plate 78.

For the 270 to 500 MHz band, a cavity 90 is provided with a meander line 92 having an upper element 94 capacitively coupled to plate 78.

Figure 7:
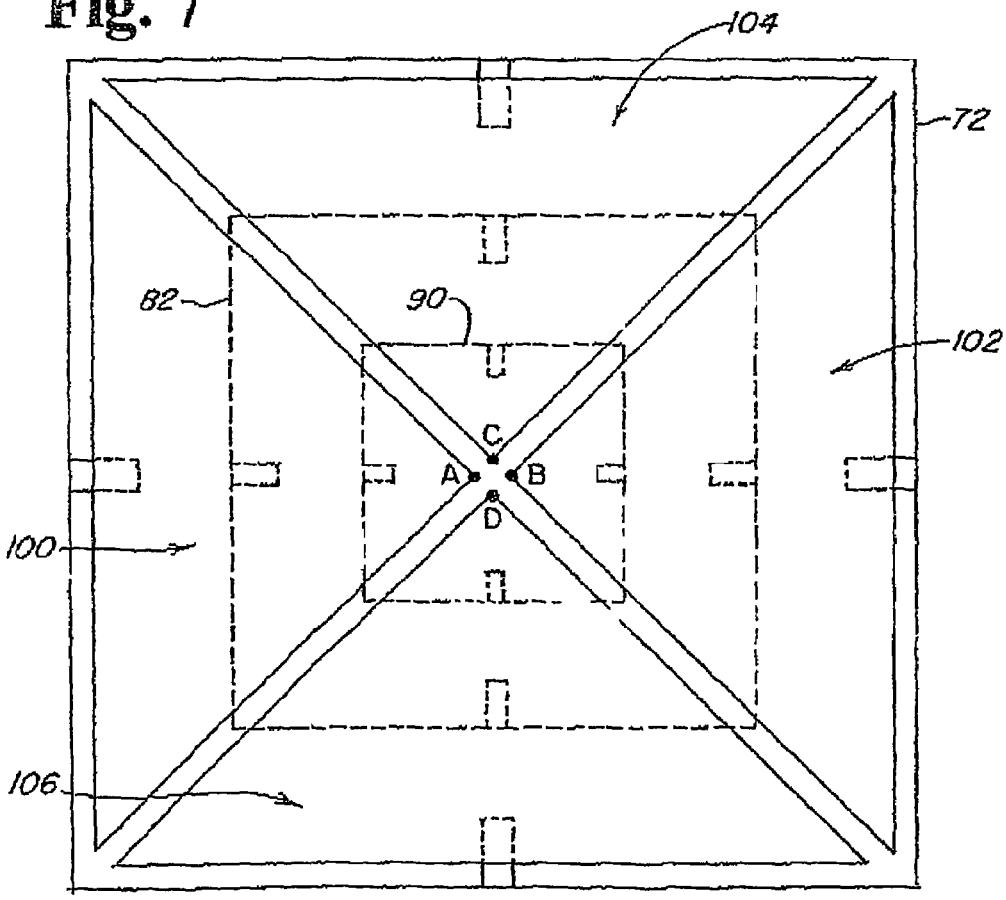
FIG. 7 is a top and schematic view of the antenna of FIG. 6, showing a quad ground plane arrangement fed such that the antenna has a horizontal polarization, a vertical polarization, and a right and left hand circular polarization.

When the antenna is to be operated in a quad fashion, and referring now to FIG. 7, bifurcated plate 78 is divided up into triangle shaped sections 100, 102, 104 and 106 as illustrated. Here the top periphery of cavity 72 is as noted, whereas the top peripheries of cavities 82 and 90 are illustrated by the associated dotted lines.

FIG. 7 constitutes a top view of the nested configuration in which the sides of the lowest frequency antenna module are 0.24λ, and where its depth is 0.088λ.

The utilization of this triangularly segmented quad configuration provides that the antenna may be feed so as to provide for a horizontal polarization, for a vertical polarization, or for a right hand and left hand circular polarization.

Referring back to FIG. 6, the common feed for all of the nested antenna modules shown as a balanced line connected to the bifurcated ground plane 78 at its most closely adjacent points A and B.

With respect to the quad configuration of FIG. 7, a balanced feed at points A and B results in a horizontal polarization, whereas a balanced feed at points C and D results in a vertical polarization. For a circular polarization one uses a 90° hybrid so that its input is a balanced line at inputs A and B and a balanced line at inputs C and D. The output of the hybrid results in right hand circular polarized and left hand circular polarized antenna patterns.

Figure 8:
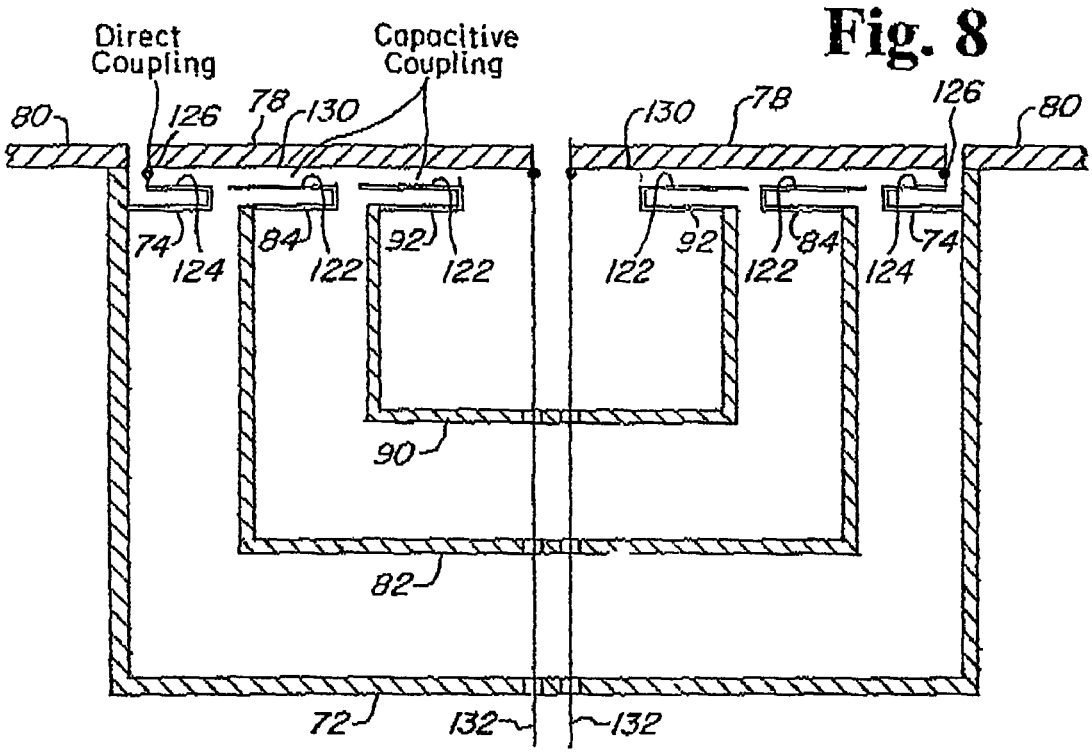
FIG. 8 is a sectional view of a nested cavity embedded meander line loaded antenna showing the nesting of the cavities which provide an ultra wide band response for the antenna.

Referring now to FIG. 8, in cross section the nested configuration of FIG. 6 includes cavities 72, 82 and 90 as illustrated, with the respective meander lines 74, 84 and 92 located at the top of the respective cavities.

Figure 10:
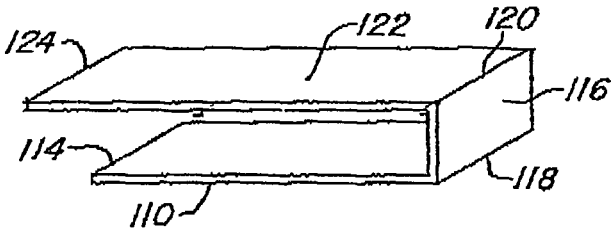
FIG. 10 is a diagrammatic illustration of a meander line for use with the nested cavity embedded meander line loaded antennas of FIG. 8.

Here, and as illustrated in FIG. 10, the meander lines have a horizontally running section 110 coupled at an end 114 to the associated cavity. There is an up standing portion 116 at the other end 118 of section 110 that connects to an end 120 of a top portion 122 of the meander line. Each meander line has a top end 124 as illustrated. It will be seen that end 124 of meander line 74 is directly coupled to bifurcated plate 78. As illustrated at 126 this provides a direct coupling of the lowest frequency cavity embedded meander line loaded antenna module to the most distal portion of the bifurcated ground plate.

Capacitive coupling of meander line cavities 84 and 92 is the result of the spacing of top portion 122 from the lower surface 130 of bifurcated ground plate 78.

Each of the antenna modules has a common balanced feed here illustrated by balanced line 132 coupled across opposed points A and B of the bifurcated ground plate 78. It will also be noted that the top periphery of cavity 72 is directly connected to the surrounding ground plane 80.

Figure 9:
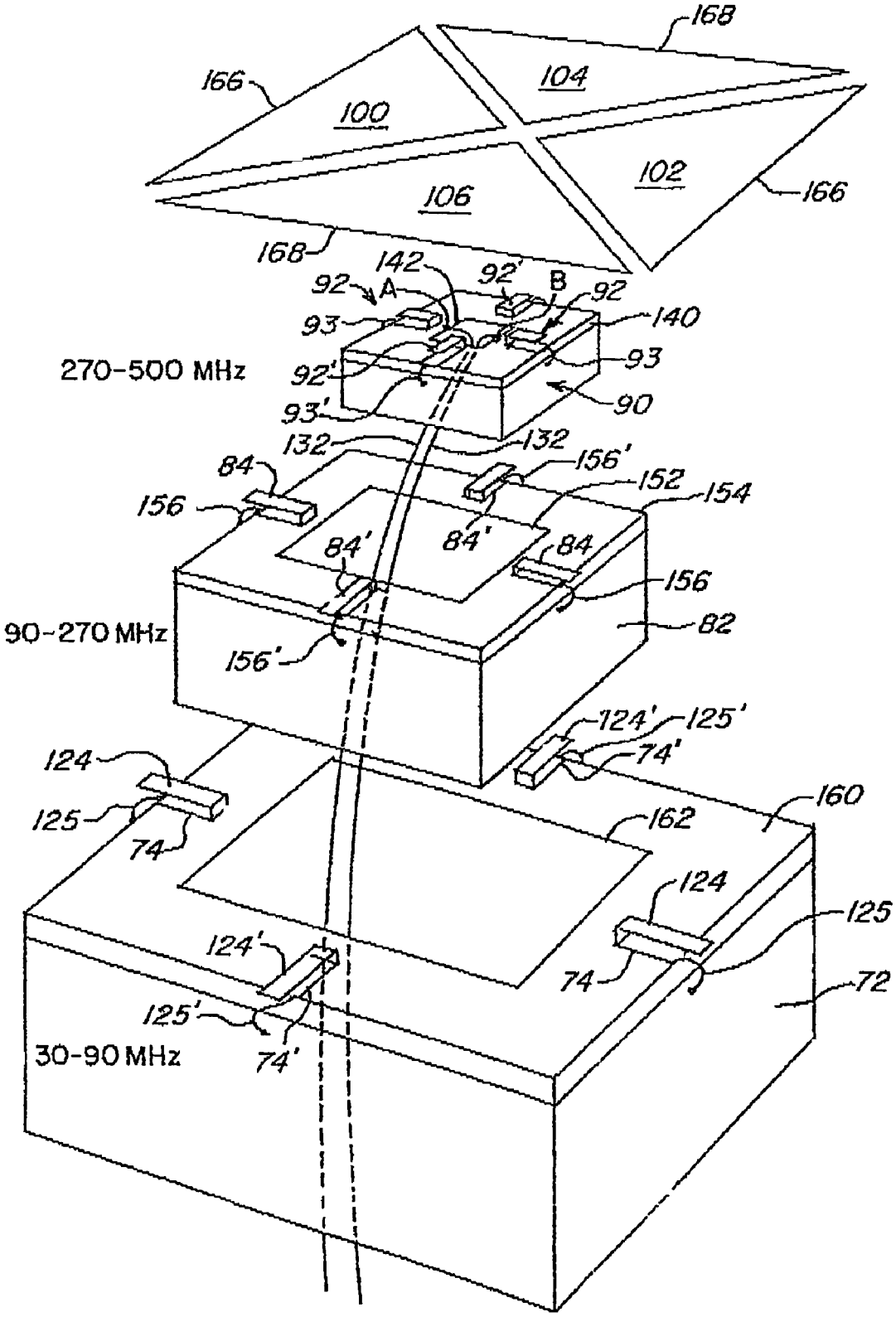
FIG. 9 is an exploded view of the cavity embedded meander line loaded antenna structure of FIG. 8 showing the nesting and embedding of the cavities beneath a quad ground plane structure.

Referring now to FIG. 9, in an exploded view the nested antenna module configuration is shown directly below the quad plate structure in which like reference characters represent like elements between FIGS. 7 and 9. Here the innermost cavity embedded meander lined loaded antenna module 90 is illustrated as having associated meander line structures 92 immediately below triangular plates 100 and 102. Note that the lower portion of the meander line is coupled by conductor 93 to cavity 90.

To address the quad structure, meander lines 92' are situated respectively below plates 104 and 106. Each of the meander lines is mounted on an apertured dielectric support plate 140 having a central aperture 142 adapted to receive balanced lines 132 so that the distal ends thereof can be attached to points A and B as illustrated. Note that the lower portion of meander lines 92' are connected by conductors 93' to cavity 90.

As can be seen, the next lower frequency antenna module has a cavity 82 into which cavity 90 nests via insertion through aperture 152 in dielectric support plate 154. Here it can be seen that meander lines 84 rest on dielectric plate 154 and are attached to the corresponding cavity via conductors 156 or other means. This connects the cavity 82 module to respective plates 100 and 102, with meander lines 84' capacitively coupling this antenna module to the appropriate super-positioned plates 104 and 106. Here conductors 156' connect the lower portions of meander lines 84' to cavity 82.

Finally, for the lowest frequency module here illustrated by cavity 72 the associated meander lines 74 are illustrated on top of a dielectric support plate 160, with plate 160 having a central aperture 162 to admit cavity 182 in a nesting relationship. Here, ends 124 of meander lines 74 are directly coupled to distal edges 166 of plates 100 and 102 respectively. The lower portions of meander lines 124 are coupled by conductors 125 to cavity 72.

Likewise, meander lines 74 have ends 124' directly coupled to distal edges 168 respectively of plates 104 and 106, with the lower portions thereof coupled by conductors 125' to cavity 72.

Figure 11:
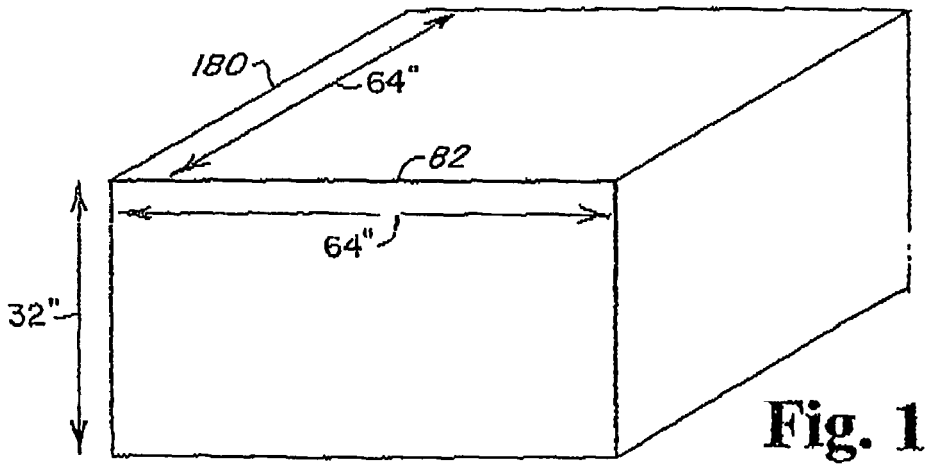
FIG. 11 is a diagrammatic illustration of the volume occupied by the nested meander line loaded antenna operating at between 30 to 500 MHz.

Referring now to FIG. 11, here can be seen that the exterior dimensions of the nested combination for the 30-500 MHz bandwidth are such that the length and width dimensions are 180 and 182 are 64 inches, whereas the depth of the cavity associated with the lowest frequency antenna module is 32 inches.

Slotline-Loaded Cavity-Embedded Antenna

As mentioned hereinbefore, a bowtie-type quad cavity-embedded antenna may be provided with meander line-like bandwidth without utilizing meander lines.

Referring now to FIG. 12, a slotline-loaded cavity antenna 200 is illustrated as having a top plate 202 spaced above a ground plane plate 204, which has a cavity 206 depending downwardly from plate 204 as illustrated. Plate 202 is subdivided into two opposed bowtie antennas, with the first bowtie having triangularly-shaped plates 208 and 210, and with the second of the bowtie antennas having plates 212 and 214. It is noted that in one embodiment the ends of the slots formed by the gaps between the bowtie elements are closed. This is because the peripheries of the bowtie elements 208-214 have uninterrupted conductive material or metal, with the associated bowtie antennas being formed by slots 220, 222, 224 and 226 as a result of the gaps between the bowtie elements. This is called the closed slot embodiment. In an open slot embodiment, bowtie elements 208-214 are supported in a plane with the distal ends of slots 220-226 open.

It is noted that these slots form an X in plate 202 such that there are apices of the bowtie elements at the center where the X crosses. These apices provide the feed points for the quad antenna, with the feed points for the first bowtie being shown at 1 and 2 and with the feed points of the second bowtie shown at points 3 and 4.

Note that the closed embodiment is different from the FIG. 7 meander line loaded embodiment, in which the bowtie antenna plates 100, 102, 104 and 106 have their distal ends unshorted. The shorting or shunting of the slots provides that the slots act as transmission lines as opposed to radiators.

Slots 220, 222, 224 and 226 are shorted in the closed illustrated embodiment by shorting stubs 230, 232, 234 and 236 respectively, with the distance of these shorting stubs from the apices of the bowties being adjustable so as to alter the impedance of the associated transmission line as seen at the feed points.

Referring to FIG. 13, cavity 206 is shown below plate 202, with plate 202 spaced from the ground plane plate 204 by a distance d. The overlap of plate 202 with respect to cavity edge 238 is indicated by b.

It is noted that the meander lines of meander line loaded cavity-embedded antennas may be replaced by slot transmission lines, with the replacement being made possible for side/depth ratios of the cavity greater than 3. The replacement of the meander line simplifies fabrication, thus reducing costs, and making this antenna amenable to commercial applications.

Note also that the ultrawide bandwidth antenna formed by a slotline-loaded cavity has a cavity size $0.16\lambda \times 0.16\lambda \times 0.05\lambda$, where $\lambda$ is the wavelength of the lowest frequency for the antenna.

The antenna of FIG. 13 may be fed via lines 240 such that these lines extend through the base 242 of cavity 206 as illustrated.

Referring to FIG. 14, the phasing of the lines that connect to points 1, 2, 3 and 4 is illustrated in which for linear polarization the loop associated with feed points 1 and 2 have the feed points 1 and 2 phased at +1 and −1, whereas the loop associated with feed points 3 and 4 has feed points 3 and 4 phased by +1 and −1. For right-hand circular polarization, feed points 1, 2, 3 and 4 are phased respectively +1, −1, +j and −j. For left-hand circular polarization, feed points 1, 2, 3 and 4 are phased respectively at +1, −1, −j and +j.

This phasing arrangement is made possible by the quad configuration described in connection with FIGS. 12 and 13.

Referring to FIG. 15, because of the above-described shunted slotline transmission lines, the impedance at the feed point of the resulting antenna indicated by signal source 250 is provided by the antenna reactance 252 in parallel with the impedance of the shunt slotline 254.

It is noted that the effect of the slotlines is to introduce a shunt transmission line across the feed points, with the shunt line being the serial/parallel combination of the four slot lines. Thus, the shunt line is simply one of the slotlines.

The antenna impedance is manipulated by adjustment of b and d of FIG. 13, which effects a change in the capacity of the antenna to the outer surface 204. Adjustment of the sliding shunt elements 230, 232, 234 and 236 adjust the impedance associated with the slot transmission lines such that, as illustrated in FIG. 16, the slotline impedance 260 cancels antenna reactance 262. This arrangement is analogous to that of the meander line loaded antennas and adjusting the meander line length and the capacitance between vertical and horizontal plates. Note that the equivalent circuits for the meander line loaded antenna and slotline loaded antenna are similar and lead to the situation depicted in FIG. 16, where the shunt slotline impedance and the antenna reactance cancel over a wide bandwidth.

As can be seen from the chart pictured in FIG. 17, adequate gain from 80 MHz to 500 MHz is achieved, with the gain measured at the zenith of the antenna.

Figure 18:
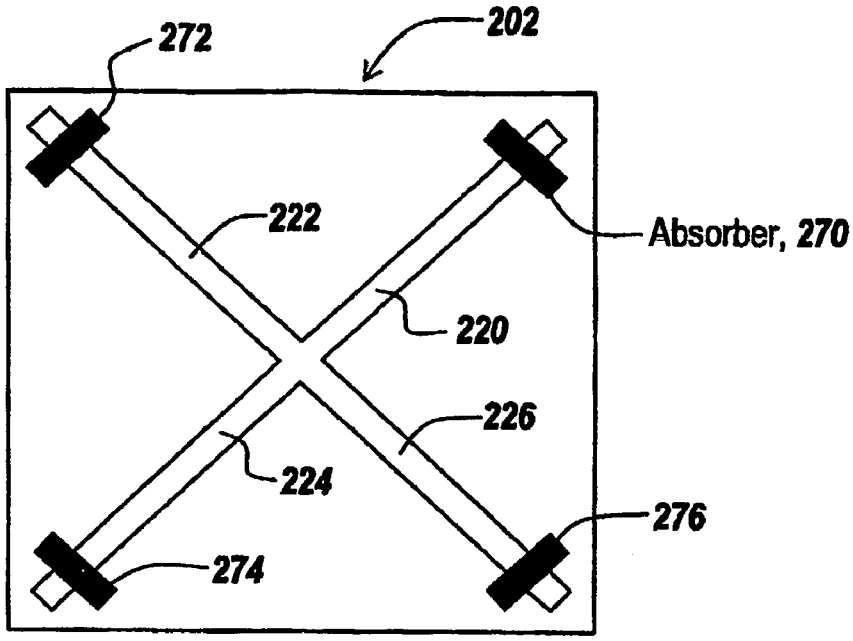
FIG. 18 is a diagrammatic illustration of the top plate of the antenna of FIG. 12, illustrating the substitution of absorbers for shorting stubs across respective slots; and, FIG. 19 is a diagrammatic illustration of an alternative method for changing the capacitance of the antenna of FIG. 12.

Referring to FIG. 18, slots 220, 222, 224 and 226 in plate 202 may be shunted by absorbers 270, 272, 274 and 276 respectively. Rather than shorting the slots which causes a back reflection at the short, the absorber is used to absorb the forward-going wave and minimize the back-reflected wave. As mentioned hereinbefore, what this accomplishes is to provide a uniform antenna pattern, albeit at the expense of gain at various points. When a perfectly-shaped antenna pattern is desired, the use of the absorber material that may be Eccosorb VF-30, which is a lossy dielectric, results in a relatively uniform dipole-like antenna pattern without having nulls or with a minimum of side lobes. Note that the volume resistivity of the Eccosorb VF-30 resistive plastic film in ohm-centimeters is 5-50, with the dielectric constant at 8.6 GHz being 37, and the dissipation factor at 8.6 GHz being 1.15. In general, the standard thickness of the layer is 0.30 inches. This material is described in PCT Patent Application No. US03/41777 filed Dec. 31, 2003 for Cavity Embedded Meander Line Loaded Antenna and Method and Apparatus for Limiting VSWR.

Figure 19:
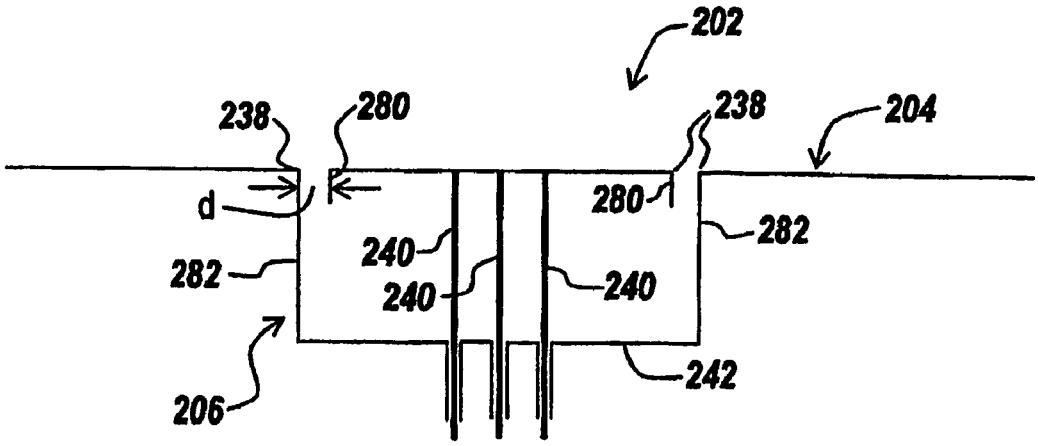

Referring now to FIG. 19, what is shown is an alternative method for adjusting the capacitance associated with the quad bowtie structure. Here a downwardly-depending portion or tab 280 is provided on either end of the bowtie elements, which tab is spaced from a wall 282 of cavity 206. Here the spacing d is what the parameter which is adjusted to effectuate the capacitance change.

What can be seen is that at least for the largest of the cavity-embedded antennas of FIGS. 6 and 7, a shunted slotline-loaded configuration can be substituted for a meander line loaded configuration, thereby to be able to produce the quad antenna at a minimal cost due to the ability to substitute the shunt elements for the meander line elements. Since the shunted slotlines perform as transmission lines in much the same way as meander lines do, the impedance of these slotline transmission lines is utilized to cancel antenna reactance, thus to provide for the wideband result.

Having now described a few embodiments of the invention, and some modifications and variations thereto, it should be apparent to those skilled in the art that the foregoing is merely illustrative and not limiting, having been presented by the way of example only. Numerous modifications and other embodiments are within the scope of one of ordinary skill in the art and are contemplated as falling within the scope of the invention as limited only by the appended claims and equivalents thereto.

What is claimed is:

1. A cavity-embedded antenna comprising:

a ground plane having a cavity depending therefrom in a central region thereof;

a slotted plane spaced from said ground plane and overlying the opening of said cavity, said plate having a pair of crossed slots therein defining a pair of bowtie antennas, said bowtie antennas having triangular-shaped elements, the apices of opposed triangular-shaped elements forming feed points for the associated bowtie antennas;

a number of shunting elements across the distal ends of respective slots, the spacing of said shunting elements to said apices determining the transmission line impedance associated with the slots, said shunting elements including lossy dielectric material having a resistivity to provide that said shunting elements act as absorbers whereby said antenna is loaded by said slotline transmission lines.

2. The antenna of claim 1, wherein the distal ends of said slots are terminated by said plate, the distal ends of said slots being closed.

3. The antenna of claim 1, wherein the distal ends of said slots are open and wherein said shunting elements are sufficiently close to the distal ends of said slots that the associated transmission lines provide the requisite impedance to cancel the reactance of said antenna.

4. The antenna of claim 1, wherein said shunting elements include conductive material so as to short respective slots of said shunt elements.

5. The antenna of claim 1, wherein said lossy dielectric material is in the form of a resistive plastic sheet.

6. A cavity-embedded antenna comprising:

a ground plane having a cavity depending therefrom in a central region thereof;

a slotted plane spaced from said around plane and overlying the opening of said cavity, said plate having a pair of crossed slots therein defining a pair of bowtie antennas, said bowtie antennas having triangular-shaped elements, the apices of opposed triangular-shaped elements forming feed points for the associated bowtie antennas;

a number of shunting elements across the distal ends of respective slots, the spacing of said shunting elements to said apices determining the transmission line impedance associated with the slots, whereby said antenna is loaded by said slotline transmission lines, said pair of bowtie antennas being fed at respective feed points such as to give said antenna a linear polarization or a circular polarization, depending on the phasing of the signals applied to said feed points.

* * * * *